US008758568B2

(12) United States Patent
Pilsbury et al.

(10) Patent No.: US 8,758,568 B2
(45) Date of Patent: Jun. 24, 2014

(54) PAPERMAKING CLOTHING DEFINING A WIDTH OF A PAPER WEB AND ASSOCIATED SYSTEM AND METHOD

(75) Inventors: Joseph R. Pilsbury, Westbrook, ME (US); Stacie R. Dede, Hammaro (SE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 13/565,442

(22) Filed: Aug. 2, 2012

(65) Prior Publication Data

US 2012/0291973 A1 Nov. 22, 2012

Related U.S. Application Data

(62) Division of application No. 12/024,333, filed on Feb. 1, 2008, now Pat. No. 8,241,464.

(51) Int. Cl.
*D21F 5/18* (2006.01)
*D21F 7/12* (2006.01)

(52) U.S. Cl.
USPC ..... 162/290; 162/207; 162/353; 162/902; 34/95

(58) Field of Classification Search
CPC ..... D21F 1/0027; D21F 5/182; D21F 7/006; D21F 2/00; D21F 5/00; D21F 5/14; D21F 5/143; D21F 5/18; D21F 5/181; D21F 5/184; D21F 5/185; D21F 7/12; D21F 11/145; F26B 3/06; F26B 13/007; F26B 13/008; F26B 13/101; F26B 13/103; F26B 13/108; F26B 13/16; F26B 13/18; F26B 13/30
USPC ..... 162/348, 117, 358.2, 358.4, 361, 362, 162/900–904, 207, 217, 290, 353, 375; 34/95; 428/192–194; 139/383 A, 425 A, 139/383 AA
See application file for complete search history.

(56) References Cited

U.S. PATENT DOCUMENTS 2,271,295 A 1/1942 Gates
2,659,958 A 11/1953 Johnson
(Continued)

FOREIGN PATENT DOCUMENTS

DE 201 07 846 U 9/2001
DE 103 41 183 * 3/2005
(Continued)

OTHER PUBLICATIONS

DE 103 41 183, Mar. 2005, English language machine translation [retrieved from http://www.epo.org].*

(Continued)

*Primary Examiner* — Eric Hug
(74) *Attorney, Agent, or Firm* — Frommer Lawrence & Haug LLP; Ronald R. Santucci

(57) ABSTRACT

A clothing for supporting a wet paper web for dewatering is provided, comprising a dewatering fabric extending in a machine direction and formed only from a woven material to have a single, substantially consistent, permeability. A pair of laterally-spaced strip portions extend along the dewatering fabric in the machine direction, with each being substantially and consistently impermeable to air and forming a substantially and consistently smooth non-water-retaining surface. The strip portions define a permeable web-carrying portion of the dewatering fabric therebetween, wherein the paper web carried thereby extends over the entire width thereof. The permeable web-carrying portion allows air to flow therethrough, exclusively of the impermeable strip portions, such that the wet paper web carried only by the permeable web-carrying portion is dewatered. The width of the permeable web-carrying portion thereby defines the width of the wet paper web dried thereon. Associated systems and methods are also provided.

23 Claims, 9 Drawing Sheets

(56) References Cited

U.S. PATENT DOCUMENTS

| | | | |
|---|---|---|---|
| 3,523,867 | A | 8/1970 | MacBean |
| 3,652,390 | A | 3/1972 | Peterson |
| 3,736,672 | A | 6/1973 | Skewis et al. |
| 3,867,766 | A | 2/1975 | Wagner |
| 4,452,284 | A | 6/1984 | Eckstein et al. |
| 4,537,658 | A | 8/1985 | Albert |
| 4,588,632 | A | 5/1986 | Gisbourne et al. |
| 4,784,190 | A | 11/1988 | Mullaney |
| 5,397,438 | A | 3/1995 | Nyberg et al. |
| 6,170,126 | B1 | 1/2001 | Stahlecker |
| 6,314,659 | B1 | 11/2001 | Parker |
| 6,425,164 | B2 | 7/2002 | Stahlecker |
| 6,503,602 | B1 | 1/2003 | Crosby |
| 6,746,573 | B2 | 6/2004 | Stelljes, Jr. et al. |
| 2003/0188615 | A1 | 10/2003 | Ripley |
| 2004/0020549 | A1 | 2/2004 | Augscheller et al. |
| 2007/0068030 | A1 | 3/2007 | Fernandes et al. |
| 2008/0092979 | A1 | 4/2008 | Harwood et al. |

FOREIGN PATENT DOCUMENTS

| | | | |
|---|---|---|---|
| EP | 0 969 144 | A | 1/2000 |
| EP | 1 662 038 | A | 5/2006 |
| EP | 1 767 693 | A | 3/2007 |
| EP | 1 845 190 | A | 10/2007 |
| GB | 1 201 771 | | 8/1970 |
| GB | 1 292 860 | | 10/1972 |
| WO | WO 2005/116332 | | 12/2005 |
| WO | WO2008/118909 | A | 10/2008 |

OTHER PUBLICATIONS

DE 10341183, Mar. 2005, English language machine translation [retrieved from http://www.epo.org, Aug. 2013].*

European Search Report for corresponding European application 13172948.5 dated Sep. 9, 2013.

European Search Report for corresponding European application 13172953.5 dated Sep. 2, 2013.

International Search Report from corresponding International Application PCT/SE2009/000033 dated May 7, 2009.

* cited by examiner

FIG. 2 – PRIOR ART

FIG. 3 – PRIOR ART

FIG. 4 – PRIOR ART

FIG. 5 – PRIOR ART

PAPERMAKING CLOTHING DEFINING A WIDTH OF A PAPER WEB AND ASSOCIATED SYSTEM AND METHOD

This application is a division of U.S. patent application Ser. No. 12/024,333 filed Feb. 1, 2008, now U.S. Pat. No. 8,241,464, the entire disclosure of which is incorporated herein by reference.

BACKGROUND OF THE INVENTION

1. Field of the Invention

Embodiments of the present invention are directed to a papermaking clothing and associated system and method for producing a defined-width paper web and, more particularly, to a through-air drying papermaking system and associated clothing and method implementing a through-air drying fabric having laterally-spaced impermeable strips such that the fabric therebetween defines the width of a paper web.

2. Description of Related Art

In a representative papermaking process, a fibrous slurry (i.e., an aqueous wood pulp or cellulose fiber mixture) is deposited on a moving forming wire from a headbox. The open structure of the forming wire allows some of the water from the slurry to drain therethrough, wherein the remaining cellulose fibers adhere to each other to form a fibrous web. Since the forming wire moves in a machine direction during the deposition of the fibrous slurry, an elongate wet paper web is formed. Further, a representative papermaking machine as shown, for example, in FIG. 1, is often configured to produce a paper web of a certain width and, as such, the wet paper web formed on the forming wire must usually have the lateral boundaries trimmed in an edge trimming process. Edge trimming provides defined lateral edges of the paper web before the web is directed downstream in the machine direction for further processing, which may include, for example, pressing and/or drying sections.

In one edge trimming process, a high pressure water stream is directed through a water jet or nozzle toward the formed paper web as it is transported on the forming wire (i.e., the inner forming wire) in the machine direction, as shown, for example, in FIG. 2. The water is sprayed from the jet/nozzle to create a constant stream of water with high enough pressure to cut through, or in effect push aside fibers in a limited width of the sheet, but yet with low enough pressure and laminar flow to minimize spraying of water onto the rest of the paper web outside of the cut. The water flow must also be regulated to prevent damage to the forming wire. This edge trimming process is generally performed at between 12% and 30% dryness of the paper web, where the result is to define the outermost lateral edges of the paper web. In some papermaking processes, there may be a second cutting operation performed further downstream in the machine direction (i.e., later in the papermaking process), generally termed the inner edge cut. In any instance, the edge cutting or edge trimming system typically requires a significant amount of fresh water, piping and associated fixtures for controlling the flow of the water, various filters, a powered pump, and a spray jet/nozzle with an appropriate water control configuration for each cut and type of cut of the paper web. As such, the edge cutting or edge trimming system may be, for example, cost and maintenance intensive, resource (water) and energy inefficient, and difficult to correctly set up for alignment with, for instance, pickup vacuum box edges, molding box edges, and TAD-installed deckle bands along the machine direction in the papermaking process.

In some papermaking processes, once the paper web has proceeded through the edge trimming process, it is then directed through a dewatering process, such as a drying process. In one such drying process, one or more through-air dryers (TADs) may be implemented to dry the web. A typical TAD includes a cylindrical roll (otherwise referred to herein as a "TAD cylinder"), wherein the shell defining the cylindrical roll is configured and structured so as to allow air to pass through the cylindrical shell, about which the paper web is at least partially wrapped during the drying process. A TAD further includes a hood configured to substantially encompass the roll of the TAD, wherein air is typically heated and directed from the hood and into the roll through the shell, or from the roll through the shell and into the hood. In any instance, the air is directed through the paper web wrapped about the roll to facilitate drying thereof. The paper web, when transported through the TAD, is typically supported by an endless web-carrying fabric (otherwise referred to herein as a "TAD fabric"). Thus, the air directed through the paper web must also pass through the TAD fabric.

In some instances, however, the TAD fabric for transporting the paper web through the TAD may be a costly part of the paper production process. For example, mechanical deckle bands may be installed on the cylinder, in a laterally spaced apart relation, so as to define the "drying area" of the TAD. That is, such deckle bands may be, for example, impermeable strips of an impermeable material that are physically placed over the TAD cylinder at or about the edges/flanges thereof in order to block or re-direct air flow through the shell of the TAD cylinder. In such a configuration, the deckle bands are installed on the TAD cylinder at two spaced-apart positions across the width of the roll, and the TAD fabric is further configured to laterally extend across the roll and over both deckle bands. The width of the TAD fabric between the deckle bands thus defines the drying area of the TAD, where a paper web up to that width can be dried by the TAD. One disadvantage with such deckle bands, though, is that the placement thereof with respect to the roll for defining the drying area can be difficult to determine with accuracy due to, for example, the thermal expansion behavior of the roll. As such, temporary deckle bands may initially be used, with such temporary deckle bands being comprised of, for example, a polytetrafluoroethylene material, secured to the roll by temporary adhesives during set-up of the papermaking machine. This initial set-up, in some instances, may be costly in terms of the time and the trial-and-error resources needed to determine the appropriate positions of the deckle bands.

Once the appropriate positions of the temporary deckle bands are determined, deckle bands for use in the long term papermaking process can be installed on the roll. Such deckle bands may be comprised of a more durable material such as, for example, stainless steel, welded to the roll or the end rings thereof in the determined positions. However, one drawback of these metallic deckle bands is that, under certain conditions, the deckle bands may cause corrosion of the roll or the end rings thereof. Further, these deckle bands installed on the roll may be difficult to clean under/around. Also, between the initial set-up and actual (long term) production, machine parameters may be altered which may, in turn, change the requirements for the deckle bands. As such, the deckle bands may not be installed until immediately prior to production, which may result in delays and/or scheduling issues as a result of their implementation. As a result, the installation of the deckle bands for the long term papermaking process may also be costly in terms of time and resources.

In papermaking machines implementing a TAD having deckle bands affixed to the TAD roll, the paper web dried thereby is typically transferred to the TAD fabric or clothing such that there is an open lateral gap of the fabric between each edge of the paper web and the respective adjacent deckle band as shown, for example, in FIG. 3. Such a configuration may be necessary, for example, to minimize the risk of the paper web and/or the fabric/clothing shifting laterally such that the paper web extends outwardly of the deckle band, where it will not be dried. The heated air directed at the paper web supported by the fabric causes drying of the web through evaporation, and essentially protects the fabric from the full temperature of the heated air through, for example, an evaporative cooling mechanism. The paper web further causes resistance to the air passing therethrough, wherein the air is then more likely to flow through a path of least resistance which essentially comprises the fabric gap between each edge of the paper web and the respective deckle bands. However, as a result, the fabric gap is exposed to full temperature supply air during the web drying process, which heats the fabric only in the fabric gap area thereof. Generally, higher temperatures of the heated air minimize drying time for the paper web which, in turn allows the speed of the papermaking machine to be increased. However, the high temperatures of the drying air and/or mechanical wear at those higher temperatures may tend to cause the premature degradation of the fabric, particularly in the gap area. As such, frequent replacement of degraded fabric results in costs associated with the fabric replacement, as well as the costs of machine down time.

In order to address/minimize fabric degradation, some papermaking machines implement various fabric edge protection measures such as, for example, air knife edge cooling as shown, for example, in FIG. 4. In an air knife edge cooling process, cool air is blown onto the fabric gap area from immediately adjacent to the hot air supplied from a heated air supply duct for the TAD. The cool air is directed at the fabric gap, thereby creating a wall of cool air about the lateral edges of the paper web that minimizes the amount of hot air flowing though the fabric gap, while simultaneously cooling the fabric in the gap. However, air knife edge cooling may be sensitive to, for example, unbalanced air pressure (i.e., imbalance between the heated air and cooling air supply pressures) or the imprecise angular direction of the air supply. In such instances, a wet sheet or an ineffective air knife may result. Further, an air knife may be incapable of handling high temperature supply air found in some newer TAD papermaking machines. In addition, an air knife system may be equipment-intensive, requiring fans, ducting, sensors, and associated equipment. As such, the air knife system may be costly, complex and difficult to set up/install, difficult/expensive to alter for process changes, large, bulky, maintenance intensive, energy inefficient, and only marginally effective even when properly set up.

In some instances, a water spray edge protection system (see, e.g., U.S. Pat. No. 6,314,659) may also be implemented, as shown in FIG. 5, for protecting the fabric about the gap. Though this method is effective in protecting the fabric, much equipment may be required, correct setup thereof may be complicated, and major maintenance issues may be encountered.

Some existing devices and methods for addressing the fabric gap about each lateral edge of a paper web in a TAD papermaking machine thus may not provide a simple and effective method of changing the width of a paper web capable of being processed by the papermaking machine since the width of the paper web may often be determined by "permanently-installed" TAD deckle bands (or "deckles"). Further, efforts to address the fabric gap, as discussed above, may often be energy and resource inefficient (i.e., high energy consumption due to, for example, poor heat transfer and removal of water brought into the TAD by the fabric), and may overall be less than particularly effective for the intended purpose.

Thus, there exists a need for a system, apparatus and method for determining a width of a paper web in a papermaking machine, particularly a TAD papermaking machine in a process-effective manner. A solution should desirably involve minimal equipment, should be relatively simple and cost effective, should be capable of being readily altered for different web widths without extensive set up and testing requirements, and should facilitate maintenance of the papermaking machine. Such a solution should also desirably provide protection for the fabric gap of the drying fabric so as to prevent or minimize premature degradation thereof, while addressing energy consumption issues such as the amount of water brought into the TAD by the drying fabric, and a more complete and effective use of the heated air used in the TAD for drying the paper web.

BRIEF SUMMARY OF THE INVENTION

The above and other needs are met by embodiments of the present invention which, according to one aspect, provides a papermaking clothing configured to support a wet paper web for dewatering and/or drying. Such a clothing comprises an endless web-carrying fabric formed only from a woven material so as to have a single, substantially consistent, permeability, wherein the web-carrying fabric defines a machine direction and has opposed lateral edges. A pair of laterally spaced apart strip portions extend along the web-carrying fabric in the machine direction, wherein each strip portion is substantially and consistently impermeable to air and has a substantially and consistently smooth surface adapted to not retain water, wherein the strip portions define a permeable portion of the web-carrying fabric therebetween. The permeable portion of the web-carrying fabric is adapted such that the wet paper web supported thereby extends over an entire width thereof. The permeable portion of the web-carrying fabric is thereby configured to allow air directed thereat to flow therethrough, exclusively of the impermeable strip portions, such that the wet paper web supported only by the permeable portion of the web-carrying fabric is dewatered, wherein the width of the permeable portion of the web-carrying fabric between the impermeable strip portions defines a width of the wet paper web being dewatered thereon.

That is, one aspect of the present invention comprises:

A papermaking clothing configured to support a wet paper web for dewatering, said clothing comprising:

an endless web-carrying fabric formed only from a woven material so as to have a single, substantially consistent, permeability, the web-carrying fabric defining a machine direction and having opposed lateral edges; and a pair of laterally spaced apart strip portions extending along the web-carrying fabric in the machine direction, each strip portion being substantially and consistently impermeable to air and having a substantially and consistently smooth surface adapted to not retain water, the strip portions defining a permeable portion of the web-carrying fabric therebetween, the permeable portion being adapted such that the wet paper web supported thereby extends over an entire width thereof, whereby the permeable portion is configured to allow air directed thereat to flow therethrough, exclusively of the impermeable strip portions, such that the wet paper web supported only by the permeable portion is dewatered, the width of the permeable portion between the impermeable strip portions thereby defining a width of the wet paper web being dewatered.

Another aspect of the present invention provides a system for drying a wet paper web, comprising at least one through-air dryer having a cylinder defined by a shell configured so as to allow air to pass therethrough. The cylinder is further configured to rotate in a machine direction. An endless drying fabric is formed only from a woven material so as to have a single, substantially consistent, permeability. The drying fabric defines a machine direction, has opposed lateral edges, and is wrapped about at least a portion of the cylinder. The drying fabric further includes a pair of laterally spaced apart strip portions extending along the drying fabric in the machine direction, wherein each strip portion is substantially and has a substantially and consistently smooth surface adapted to not retain water. The strip portions define a web-carrying portion of the drying fabric therebetween. The web-carrying portion of the drying fabric is configured such that the wet paper web supported thereby, on a web-side surface thereof, extends over an entire width thereof, whereby the web-carrying portion of the drying fabric is configured to allow air directed thereat by the at least one through-air dryer to flow therethrough, exclusively of the strip portions, such that the wet paper web supported only by the web-carrying portion of the drying fabric is dried. The width of the web-carrying portion of the drying fabric between the strip portions thereby defines a width of the wet paper web being dried by the at least one through-air dryer.

That is, another aspect comprises:

A system for drying a wet paper web, comprising:

at least one through-air dryer including a cylinder defined by a shell configured so as to allow air to pass therethrough, the cylinder being further configured to rotate in a machine direction; and an endless drying fabric formed only from a woven material so as to have a single, substantially consistent, permeability, the drying fabric defining a machine direction, having opposed lateral edges, and being wrapped about at least a portion of the cylinder, the drying fabric further including a pair of laterally spaced apart strip portions extending along the drying fabric in the machine direction, each strip portion being substantially and consistently impermeable and having a substantially and consistently smooth surface adapted to not retain water, the strip portions defining a web-carrying portion of the drying fabric therebetween, the web-carrying portion being configured such that the wet paper web supported thereby, on a web-side surface thereof, extends over an entire width thereof, whereby the web-carrying portion is configured to allow air directed thereat by the at least one through-air dryer to flow therethrough, exclusively of the strip portions, such that the wet paper web supported only by the web-carrying portion is dried, the width of the web-carrying portion between the strip portions thereby defining a width of the wet paper web being dried by the at least one through-air dryer.

A further aspect of the present invention provides a method of dewatering a wet paper web. Such a method comprises carrying a wet paper web in a machine direction with an endless web-carrying fabric formed only from a woven material so as to have a single, substantially consistent, permeability. The web-carrying fabric has opposed lateral edges and further includes a pair of laterally spaced apart strip portions extending along the web-carrying fabric in the machine direction, wherein each strip portion is substantially and consistently impermeable and has a substantially and consistently smooth surface adapted to not retain water. The impermeable strip portions define a permeable portion of the web-carrying fabric therebetween. The permeable portion of the web-carrying fabric is further configured such that the wet paper web carried thereby extends over an entire width thereof. Air is then directed toward the web-carrying fabric, wherein the permeable portion of the web-carrying fabric is configured to allow the air to flow therethrough, exclusively of the impermeable strip portions, such that the wet paper web carried only by the permeable portion of the web-carrying fabric is dried. The width of the permeable portion of the web-carrying fabric between the impermeable strip portions thereby defines a width of the wet paper web being dewatered on the web-carrying fabric.

That is, another aspect comprises:

A method of dewatering a wet paper web, comprising:

carrying a wet paper web in a machine direction with an endless web-carrying fabric formed only from a woven material so as to have a single, substantially consistent, permeability, the web-carrying fabric having opposed lateral edges and further including a pair of laterally spaced apart strip portions extending along the web-carrying fabric in the machine direction, each strip portion being substantially and consistently impermeable and having a substantially and consistently smooth surface adapted to not retain water, the impermeable strip portions defining a permeable portion of the web-carrying fabric therebetween, the permeable portion being configured such that the wet paper web carried thereby extends over an entire width thereof, and directing air toward the web-carrying fabric, the permeable portion thereof being configured to allow the air to flow therethrough, exclusively of the impermeable strip portions, such that the wet paper web carried only by the permeable portion is dewatered, the width of the permeable portion between the impermeable strip portions thereby defining a width of the wet paper web being dewatered on the web-carrying fabric.

Another aspect of the present invention provides a method of determining a width of a paper web. Such a method comprises transporting a wet paper web on a forming wire in a machine direction toward an endless dewatering and/or embossing fabric having permeable web-carrying portion, wherein the wet paper web is formed on the forming wire so as to be wider than the permeable web-carrying portion of the fabric. The embossing and/or paper web structuring fabric is formed only from a woven material so as to have a single, substantially consistent, permeability, wherein the fabric further includes opposed lateral edges and a pair of laterally spaced apart strip portions extending along the fabric in the machine direction. Each strip portion is substantially and consistently impermeable and has a substantially and consistently smooth surface adapted to not retain water. The impermeable strip portions thereby define the permeable web-carrying portion of the fabric therebetween. The wet paper web is then engaged with the dewatering and/or embossing fabric such that only the permeable web-carrying portion of the fabric receives the wet paper web, exclusively of the impermeable strip portions, thereby trimming the wet paper web to the width of the permeable web-carrying portion of the fabric such that the wet paper web extends over an entire width of the permeable web-carrying portion of the fabric.

That is, another aspect comprises:

A method of determining a width of a paper web, comprising:

transporting a wet paper web on a forming wire in a machine direction toward an endless fabric having a permeable web-carrying portion, the wet paper web being formed on the forming wire so as to be wider than the permeable web-carrying portion of the fabric, the fabric being formed only from a woven material so as to have a single, substantially consistent, permeability, the fabric further including opposed lateral edges and a pair of laterally spaced apart strip portions extending along the fabric in the machine direction, each strip portion being substantially and consistently impermeable and having a substantially and consistently smooth surface adapted to not retain water, the impermeable strip portions thereby defining the permeable web-carrying portion of the fabric therebetween; and engaging the wet paper web with the fabric such that only the permeable web-carrying portion of the fabric receives the wet paper web, exclusively of the impermeable strip portions, thereby trimming the wet paper web to the width of the permeable web-carrying portion such that the wet paper web extends over an entire width of the permeable web-carrying portion.

Yet another aspect of the present invention provides a method of processing a paper web. Such a method comprises carrying a paper web in a machine direction with an endless fabric formed only from a woven material so as to have a single, substantially consistent, permeability, wherein the fabric has opposed lateral edges and further includes a pair of laterally spaced apart strip portions extending along the fabric in the machine direction. Each strip portion is substantially and consistently impermeable, and has a substantially and consistently smooth surface adapted to not retain water. The impermeable strip portions thereby define a permeable web-carrying and structuring portion of the fabric therebetween. The permeable web-carrying portion of the fabric is configured such that the paper web carried thereby extends over an entire width thereof. Air is then directed toward the fabric so as to dewater and/or emboss the paper web to obtain an increased dryness and bulk, wherein the permeable web-carrying portion of the fabric is configured to allow the air to flow therethrough, exclusively of the impermeable strip portions, such that the paper web carried only by the permeable web-carrying portion of the fabric is processed. The width of the permeable web-carrying and structuring portion of the fabric between the impermeable strip portions thereby defines a width of the paper web being processed on the fabric. In such instances, the paper web may be processed, for example, by a vacuum device which applies suction to the paper web, by a molding device which molds or embosses the paper web according to the fabric topography such that the web bulk increases, and/or a through-air drying device which dries the paper web.

That is, another aspect comprises:

A method of processing a paper web, comprising:

carrying a paper web in a machine direction with an endless fabric formed only from a woven material so as to have a single, substantially consistent, permeability, the fabric having opposed lateral edges and further including a pair of laterally spaced apart strip portions extending along the fabric in the machine, each strip portion being substantially and consistently impermeable and having a substantially and consistently smooth surface adapted to not retain water, the impermeable strip portions defining a permeable web-carrying portion of the fabric therebetween, the permeable web-carrying portion being configured such that the paper web carried thereby extends over an entire width thereof; and directing air toward the fabric so as to process the paper web, the permeable web-carrying portion thereof being configured to allow the air to flow therethrough, exclusively of the impermeable strip portions, such that the paper web carried only by the permeable web-carrying portion is processed, the width of the permeable web-carrying portion between the impermeable strip portions thereby defining a width of the paper web being processed on the fabric.

Still another aspect of the present invention provides a method of protecting a through-air drying fabric carrying a paper web. Such a method comprises carrying a paper web in a machine direction with an endless fabric formed only from a woven material so as to have a single, substantially consistent, permeability, wherein the fabric has opposed lateral edges and further includes a pair of laterally spaced apart strip portions extending along the fabric in the machine direction. Each strip portion is substantially and consistently impermeable, and has a substantially and consistently smooth surface adapted to not retain water. The strip portions define a web-carrying portion of the fabric therebetween, wherein the web-carrying portion of the fabric is configured such that the paper web carried thereby extends over an entire width thereof. High temperature air is then directed toward the fabric such that the air flows through the web-carrying portion of the fabric, exclusively of the strip portions, and interacts with the web-carrying portion only where the paper web is carried thereby. The paper web extending across the entire width of the web-carrying portion thereby protects the web-carrying portion of the fabric from the high temperature air.

That is, another aspect comprises:

A method of protecting a through-air drying fabric carrying a paper web, comprising:

carrying a paper web in a machine direction with an endless fabric formed only from a woven material so as to have a single, substantially consistent, permeability, the fabric having opposed lateral edges and further including a pair of laterally spaced apart strip portions extending along the fabric in the machine direction, each strip portion being substantially and consistently impermeable and having a substantially and consistently smooth surface adapted to not retain water, the strip portions defining a web-carrying portion of the fabric therebetween, the web-carrying portion being configured such that the paper web carried thereby extends over an entire width thereof; and directing high temperature air toward the fabric such that the air flows through the web-carrying portion, exclusively of the strip portions, and interacts with the web-carrying portion only where the paper web is carried thereby, the paper web extending across the entire width of the web-carrying portion thereby protecting the web-carrying portion of the fabric from the high temperature air.

Another aspect of the present invention further provides a method of changing a width of a paper web within a single papermaking machine. Such a method comprises transporting a wet paper web on a forming wire in a machine direction toward a first endless fabric having a first permeable web-carrying portion, wherein the wet paper web is formed on the forming wire so as to be wider than the first permeable web-carrying portion of the first fabric. The first fabric is formed only from a woven material so as to have a single, substantially consistent, permeability, wherein the first fabric further includes a pair of laterally spaced apart first strip portions extending along the first fabric in the machine direction, with each of the first strip portions being substantially and consistently impermeable, and having a substantially and consistently smooth surface adapted to not retain water. The first impermeable strip portions thereby define the first permeable web-carrying portion of the first fabric therebetween. The wet paper web transported by the forming wire is then engaged with the first fabric such that the first permeable web-carrying portion of the first fabric receives the wet paper web, and such that the wet paper web extends over an entire width of the first permeable web-carrying portion of the first fabric, exclusively of the first strip portions, so as to trim the wet paper web to the width of the first permeable web-carrying portion of the first fabric.

The first fabric is then replaced with a second endless fabric formed only from a woven material so as to have a single, substantially consistent, permeability. The second fabric further includes a pair of laterally spaced apart second strip portions extending along the second fabric in the machine direction, with each of the second strip portions being substantially and consistently impermeable, and having a substantially and consistently smooth surface adapted to not retain water. The second impermeable strip portions thereby define a second permeable web-carrying portion of the second fabric therebetween. The wet paper web transported by the forming wire is then engaged with the second fabric such that the second permeable web-carrying portion of the second fabric receives the wet paper web, and such that the wet paper web extends over an entire width of the second permeable web-carrying portion of the second fabric, exclusively of the second impermeable strip portions. The second permeable web-carrying portion of the second fabric has a different width than the first permeable web-carrying portion of the first fabric, and is narrower than the wet paper web formed on the forming wire, so as to trim the wet paper web to the width of the second permeable web-carrying portion of the second fabric.

That is, another aspect comprises:

A method of changing a width of a paper web within a single papermaking machine, comprising:

transporting a wet paper web on a forming wire in a machine direction toward a first endless fabric having a first permeable web-carrying portion, the wet paper web being formed on the forming wire so as to be wider than the first permeable web-carrying portion of the first fabric, the first fabric being formed only from a woven material so as to have a single, substantially consistent, permeability, the first fabric further including a pair of laterally spaced apart first strip portions extending along the first fabric in the machine direction, each of the first strip portions being substantially and consistently impermeable and having a substantially and consistently smooth surface adapted to not retain water, the first impermeable strip portions thereby defining the first permeable web-carrying portion of the first fabric therebetween;

engaging the wet paper web transported by the forming wire with the first fabric such that the first permeable web-carrying portion of the first fabric receives the wet paper web and such that the wet paper web extends over an entire width of the first permeable web-carrying portion, exclusively of the first impermeable strip portions, so as to trim the wet paper web to the width of the first permeable web-carrying portion;

replacing the first fabric with a second endless fabric formed only from a woven material so as to have a single, substantially consistent, permeability, the second fabric further including a pair of laterally spaced apart second strip portions extending along the second fabric in the machine direction, each of the second strip portions being substantially and consistently impermeable and having a substantially and consistently smooth surface adapted to not retain water, the second impermeable strip portions thereby defining a second permeable web-carrying portion of the second fabric therebetween; and engaging the wet paper web transported by the forming wire with the second fabric such that the second permeable web-carrying portion of the second fabric receives the wet paper web and such that the wet paper web extends over an entire width of the permeable second web-carrying portion, exclusively of the second impermeable strip portions, the second permeable web-carrying portion having a different width than the first permeable web-carrying portion and being narrower than the wet paper web formed on the forming wire, so as to trim the wet paper web to the width of the second permeable web-carrying portion.

Still another aspect of the present invention comprises a method of forming a papermaking clothing, adapted to support a wet paper web for structuring, molding, or embossing, and/or for drying or dewatering, from an endless fabric formed only from a woven material so as to have a single, substantially consistent, permeability, with the fabric defining a machine direction and having opposed lateral edges. Such a method includes applying a self-leveling filler substance to the fabric at laterally spaced apart positions so as to form a pair of laterally spaced apart strip portions extending along the fabric in the machine direction. The self-leveling filler substance is then allowed to set such that each strip portion becomes substantially and consistently impermeable to air and forms a substantially and consistently smooth surface adapted to not retain water, whereby the strip portions define a web-carrying portion of the fabric therebetween.

That is, another aspect comprises:

A method of forming a papermaking clothing adapted to support a wet paper web for drying or dewatering, from an endless fabric formed only from a woven material so as to have a single, substantially consistent, permeability, the fabric defining a machine direction and having opposed lateral edges, said method comprising:

applying a self-leveling filler substance to the fabric at laterally spaced apart positions so as to form a pair of laterally spaced apart strip portions extending along the fabric in the machine direction; and allowing the self-leveling filler substance to set such that each strip portion becomes substantially and consistently impermeable to air and forms a substantially and consistently smooth surface adapted to not retain water, whereby the strip portions define a web-carrying portion of the fabric therebetween.

A further aspect of the present invention comprises a method of forming a papermaking clothing, adapted to support a wet paper web for drying or dewatering and/or molding and structuring, from an endless fabric formed only from a woven material so as to have a single, substantially consistent, permeability, with the fabric defining a machine direction and having opposed lateral edges. Such a method includes applying heat to the fabric at laterally spaced apart positions, wherein the heat is configured to cause the fabric at the laterally spaced apart positions to attain a material flow temperature. A pressure is applied to the fabric at the laterally spaced apart positions, substantially simultaneously with heating the fabric thereat to the material flow temperature, so as to form a pair of laterally spaced apart strip portions extending along the fabric in the machine direction, wherein each strip portion is substantially and consistently impermeable to air and forms a substantially and consistently smooth surface adapted to not retain water, and whereby the strip portions define a web-carrying portion of the fabric therebetween.

That is, another aspect comprises:

A method of forming a papermaking clothing adapted to support a wet paper web for drying or dewatering, from an endless fabric formed only from a woven material so as to have a single, substantially consistent, permeability, the fabric defining a machine direction and having opposed lateral edges, said method comprising:

applying heat to the fabric at laterally spaced apart positions, the heat being configured to cause the fabric at the laterally spaced apart positions to attain a material flow temperature; and applying a pressure to the fabric at the laterally spaced apart positions, substantially simultaneously with heating the fabric thereat to the material flow temperature, so as to form a pair of laterally spaced apart strip portions extending along the fabric in the machine direction, each strip portion being substantially and consistently impermeable to air and forming a substantially and consistently smooth surface adapted to not retain water, whereby the strip portions define a web-carrying portion of the fabric therebetween.

Another aspect of the present invention comprises a system for dewatering, drying a wet paper web. At least one processing device is configured to provide a flow of air. An embossing or structural endless fabric is formed only from a woven material so as to have a single, substantially consistent, permeability. The fabric defines a machine direction, has opposed lateral edges, and is configured to interact with the at least one processing device. The fabric further includes a pair of laterally spaced apart strip portions extending along the fabric in the machine direction, wherein each strip portion is substantially and consistently impermeable and has a substantially and consistently smooth surface adapted to not retain water. The strip portions define a web-carrying portion of the fabric therebetween, wherein the web-carrying portion is configured such that the wet paper web supported thereby, on a web-side surface thereof, extends over an entire width thereof, and whereby the web-carrying portion is configured to allow the air provided by the at least one processing device to flow therethrough and process the wet paper web, exclusively of the strip portions, such that the wet paper web supported only by the web-carrying portion is at least one of dried and dewatered. The width of the web-carrying portion between the strip portions thereby defines a width of the wet paper web being processed on the fabric by the at least one processing device.

That is, another aspect comprises:

A system for dewatering or drying a wet paper web, comprising:

at least one processing device configured to provide a flow of air; and an endless fabric formed only from a woven material so as to have a single, substantially consistent, permeability, the fabric defining a machine direction, having opposed lateral edges, and being configured to interact with the at least one processing device, the fabric further including a pair of laterally spaced apart strip portions extending along the fabric in the machine direction, each strip portion being substantially and consistently impermeable and having a substantially and consistently smooth surface adapted to not retain water, the strip portions defining a web-carrying portion of the fabric therebetween, the web-carrying portion being configured such that the wet paper web supported thereby, on a web-side surface thereof, extends over an entire width thereof, whereby the web-carrying portion is configured to allow the air provided by the at least one processing device to flow therethrough and process the wet paper web, exclusively of the strip portions, such that the wet paper web supported only by the web-carrying portion is at least one of dried and dewatered, the width of the web-carrying portion between the strip portions thereby defining a width of the wet paper web being processed on the fabric by the at least one processing device.

A further aspect of the present invention comprises a papermaking clothing configured to support a wet paper web. Such a clothing includes an endless fabric formed only from a woven material so as to have a single, substantially consistent, permeability to air of between about 2.2 m/s and about 3.0 m/s, at a pressure of about 100 Pa and a temperature of about 20° C., wherein the fabric defines a machine direction and having opposed lateral edges. A pair of laterally spaced apart strip portions extend along the fabric in the machine direction, wherein each strip portion is substantially and consistently impermeable to air and has a substantially and consistently smooth surface adapted to not retain water. The strip portions define a web-carrying portion of the fabric therebetween, wherein the web-carrying portion is adapted such that the wet paper web supported thereby extends over an entire width thereof, and whereby the web-carrying portion is configured to allow air directed thereat to flow therethrough, exclusively of the strip portions, such that the wet paper web supported only by the web-carrying portion is exposed to the air. The width of the web-carrying portion between the strip portions thereby defines a width of the wet paper web being processed.

That is, another aspect comprises:

A papermaking clothing configured to support a wet paper web, said clothing comprising:

an endless fabric formed only from a woven material so as to have a single, substantially consistent, permeability to air of between about 2.2 m/s and about 3.0 m/s, at a pressure of about 100 Pa and a temperature of about 20° C., the fabric defining a machine direction and having opposed lateral edges; and a pair of laterally spaced apart strip portions extending along the fabric in the machine direction, each strip portion being substantially and consistently impermeable to air and having a substantially and consistently smooth surface adapted to not retain water, the strip portions defining a web-carrying portion of the fabric therebetween, the web-carrying portion being adapted such that the wet paper web supported thereby extends over an entire width thereof, whereby the web-carrying portion is configured to allow air directed thereat to flow therethrough, exclusively of the strip portions, such that the wet paper web supported only by the web-carrying portion is exposed to the air, the width of the web-carrying portion between the strip portions thereby defining a width of the wet paper web being processed.

Still another aspect of the present invention comprises a composite fabric for through air drying, wherein such a composite fabric includes a fabric body fabricated from a first material and having a first side portion and a second side portion, wherein the first side portion is fabricated from a second material.

That is, another aspect comprises:

A composite fabric for through air drying comprising: a fabric body fabricated from a first material and having a first side portion and a second side portion, wherein the first side portion is fabricated from a second material.

Embodiments of the present invention thus address the needs identified above and provide significant advantages as further discussed herein.

BRIEF DESCRIPTION OF THE DRAWINGS

Figure 1:
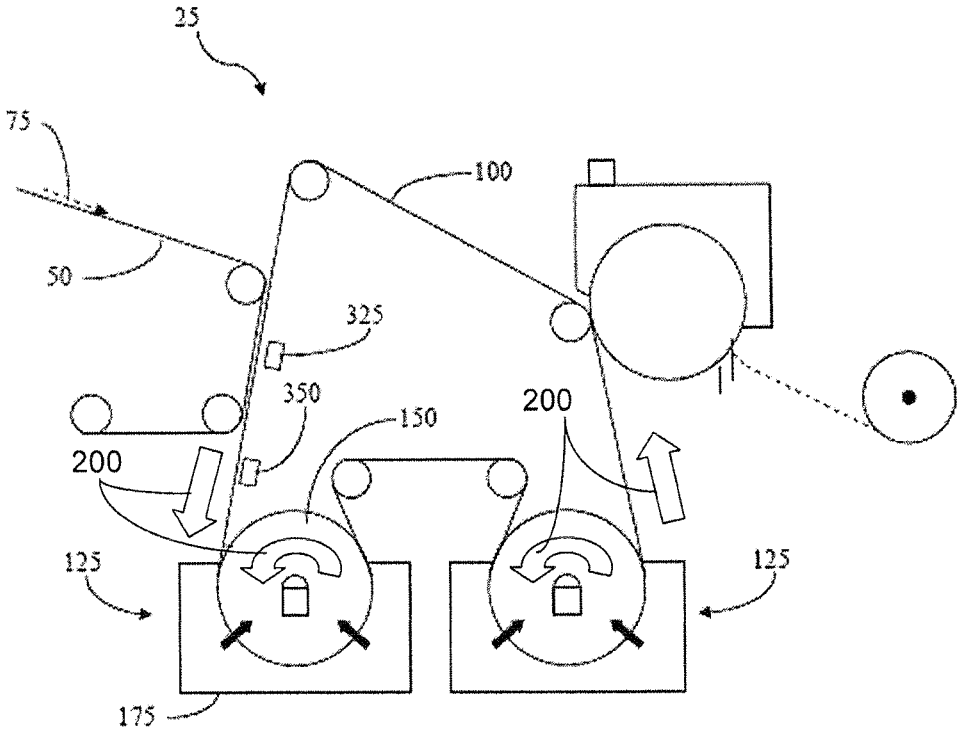
Figure 2:
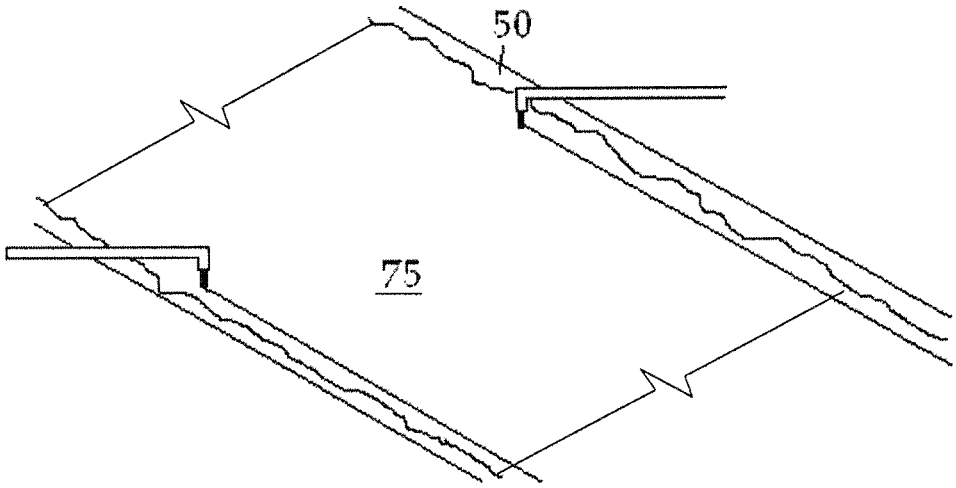
Figure 3:
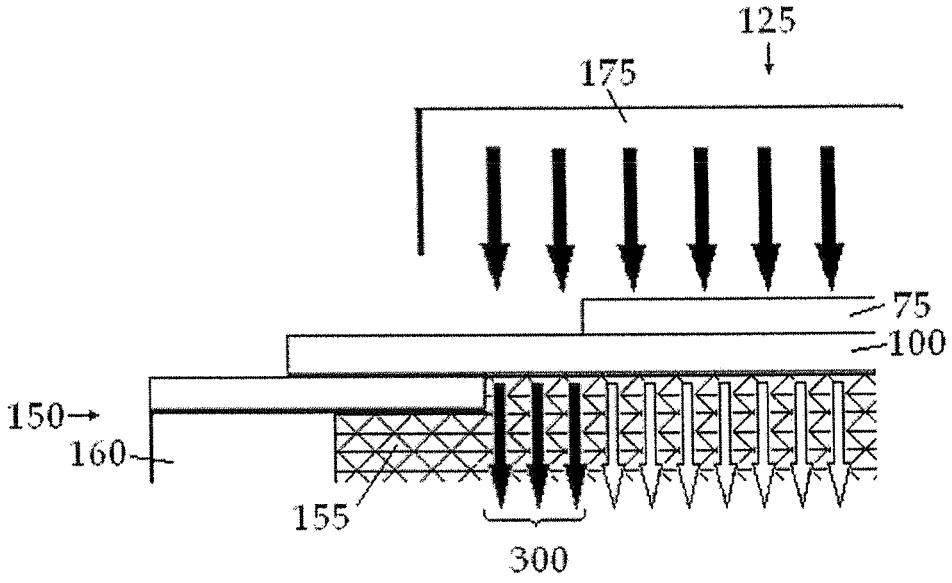
Figure 4:
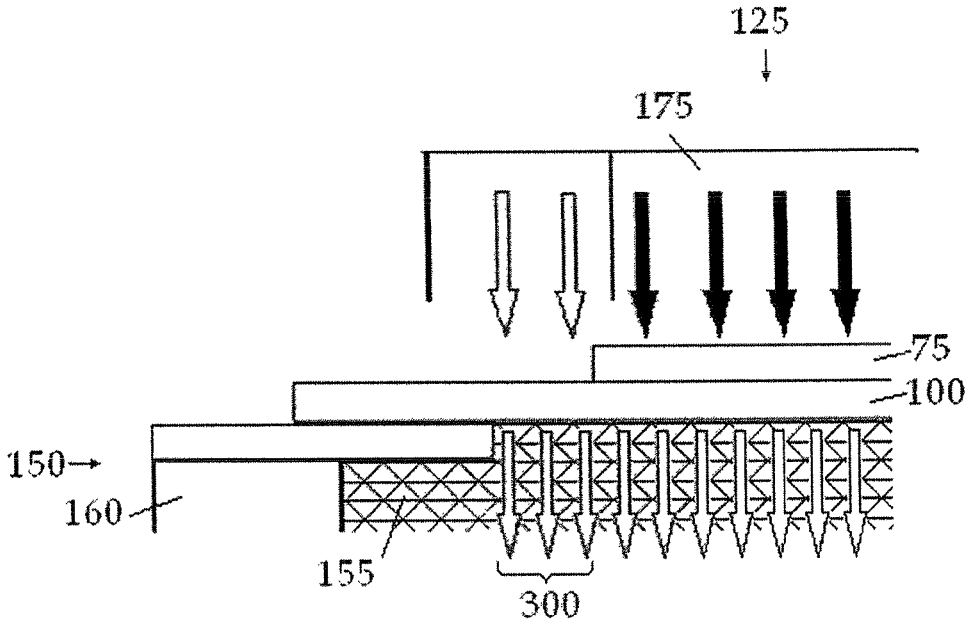
Figure 5:
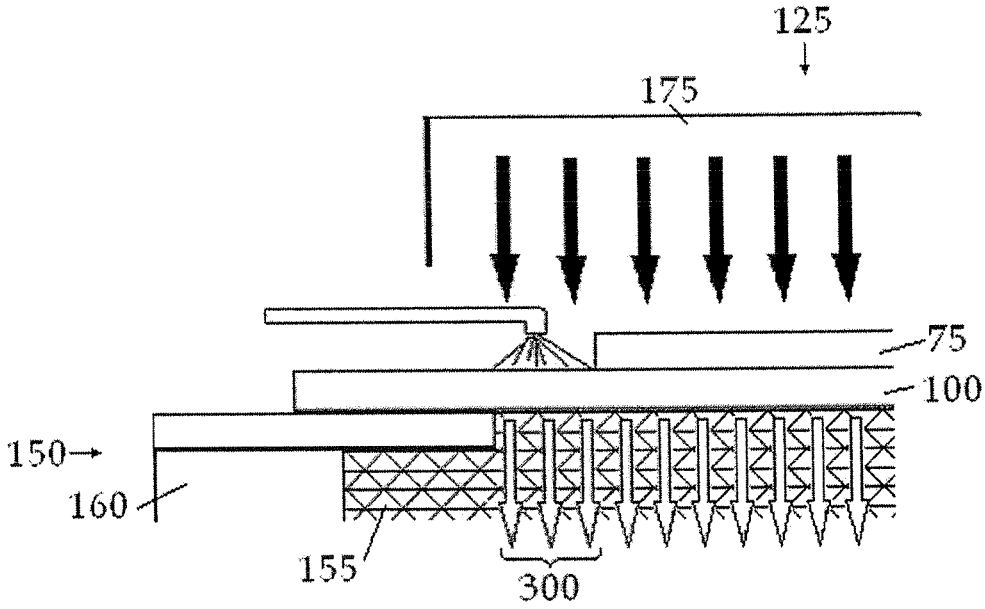
Figure 6:
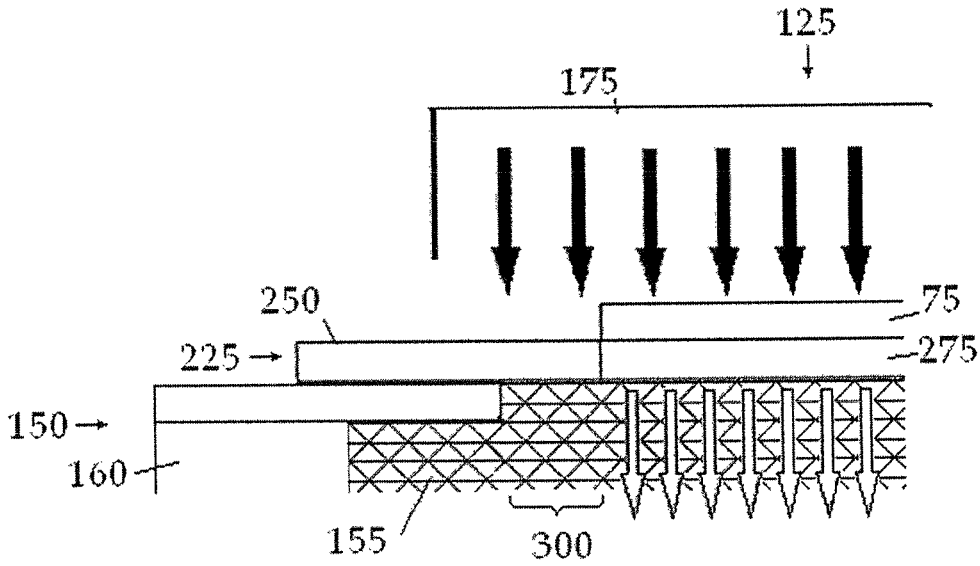
Figure 7A:
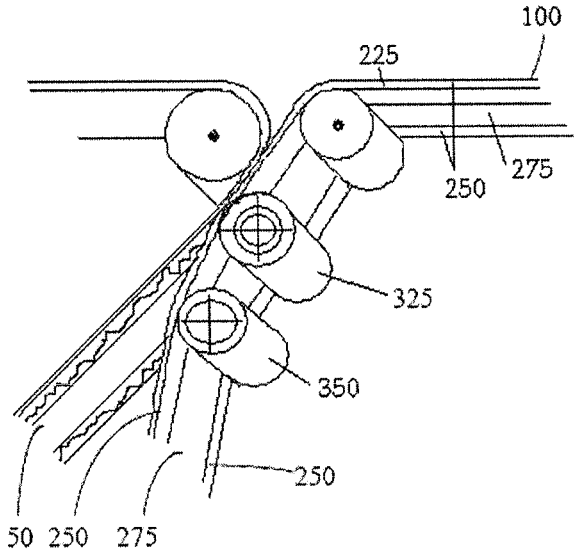
Figure 7B:
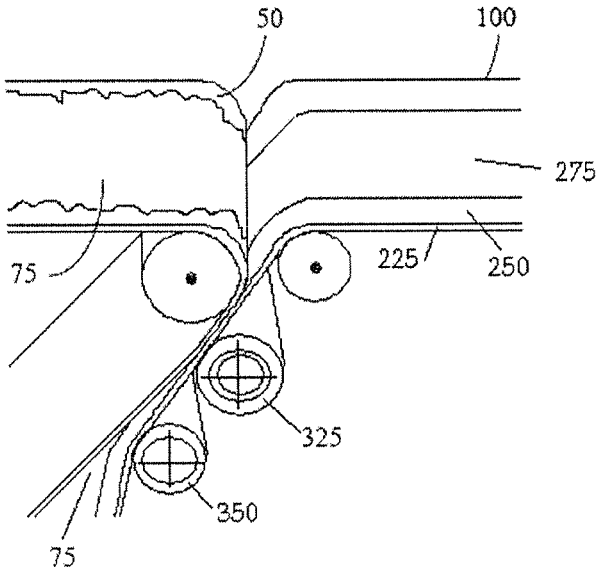
Figure 8:
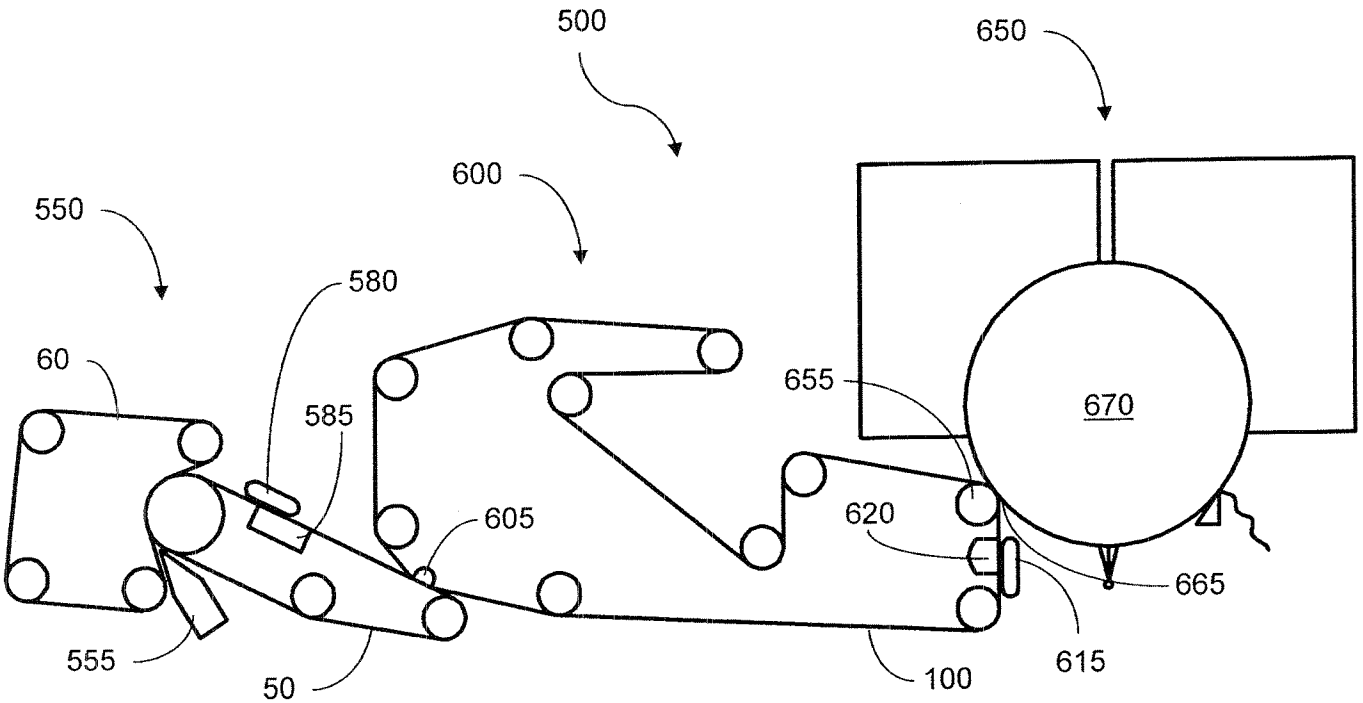
Figure 9:
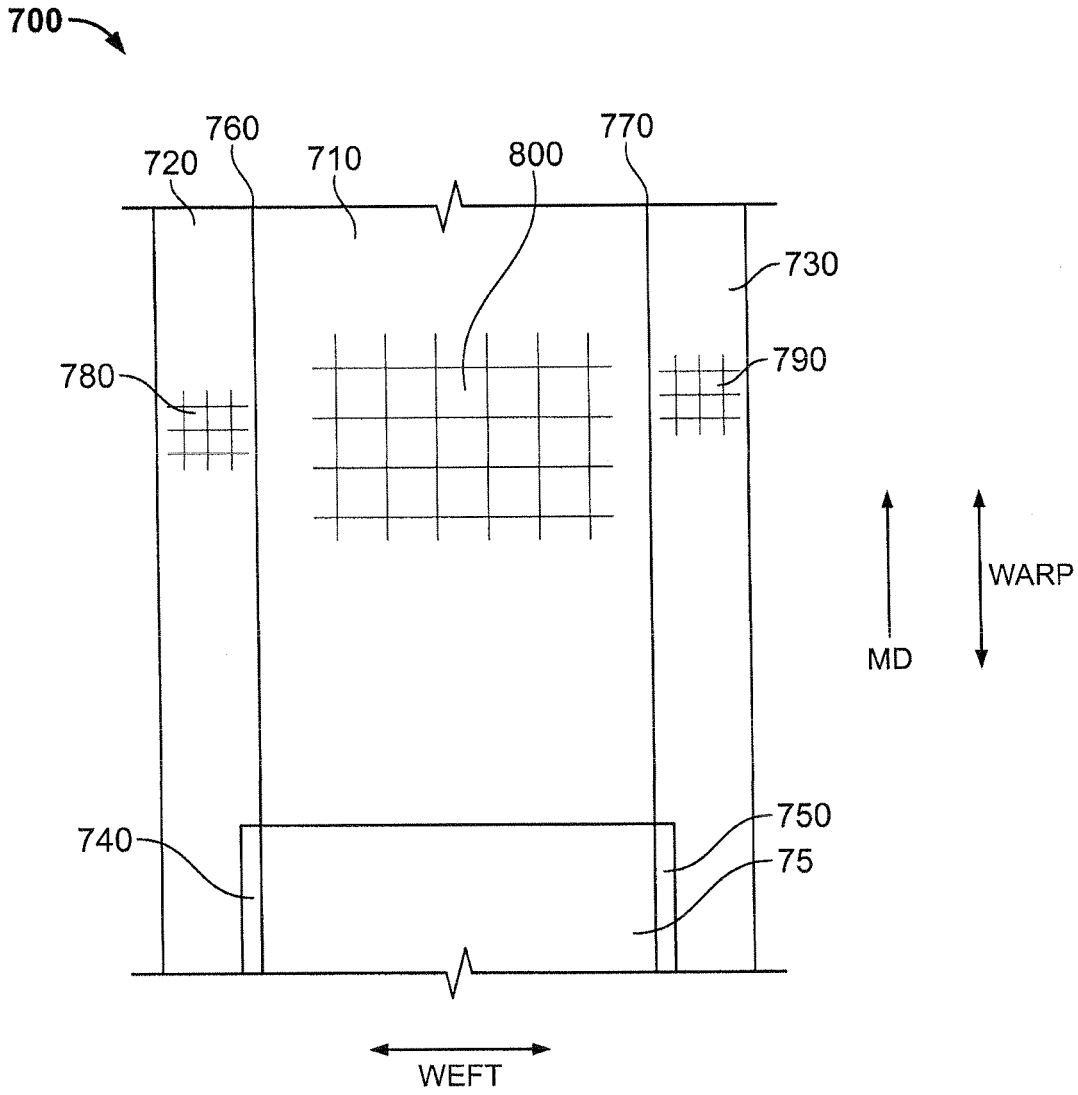

Having thus described the invention in general terms, reference will now be made to the accompanying drawings, which are not necessarily drawn to scale, and wherein:

FIG. 1 is a schematic of a representative TAD papermaking machine;

FIG. 2 is a schematic of an edge trimming method for a formed paper web;

FIG. 3 is a schematic of a through-air dryer for a papermaking machine implementing deckle bands about the TAD roll, but lacking provisions for addressing the fabric gap about the lateral edges of the paper web;

FIG. 4 is a schematic of a through-air dryer for a papermaking machine implementing deckle bands about the TAD roll, and air knife edge cooling for the fabric gap about the lateral edges of the paper web;

FIG. 5 is a schematic of a through-air dryer for a papermaking machine implementing deckle bands about the TAD roll, and water spray edge protection for the fabric gap about the lateral edges of the paper web;

FIG. 6 is a schematic of an apparatus for supporting a wet paper web for drying in a through-air dryer for a papermaking machine, according to one embodiment of the present invention, configured to provide protection for the fabric gap about the lateral edges of the paper web, without implementing deckle bands about the TAD roil;

FIGS. 7A and 7B are schematics of an apparatus and method for edge trimming of a paper web in a papermaking machine, according to one embodiment of the present invention;

FIG. 8 is a schematic of a papermaking machine implementing a twin wire former, wherein the papermaking machine is configured to produce a structured creped tissue paper using an apparatus for supporting a wet paper web according to alternate embodiments of the present invention; and FIG. 9 is a schematic plan view of a paper-side section of a composite fabric according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 schematically illustrates a representative TAD papermaking machine, indicated generally by the numeral 25. Such a papermaking machine 25 may include, for example, a forming wire 50 on which a paper web 75 is formed, and a pick-up, transfer, dewatering, drying, or other fabric 100 (which may otherwise referred to herein as "clothing 100" or papermaking clothing 100") to which the web 75 can be transferred from the forming wire 50. The papermaking machine 25 may also include one or more dryers 125, such as a through-air dryer ("TAD"). With respect to the papermaking machine 25, one skilled in the art will appreciate that many other components may be included, in a variety of combinations, and that the configuration shown in FIG. 1 is for exemplary purposes only and is not intended to be limiting or restrictive. For example, the papermaking machine 25 may include different types of headboxes or forming sections, a dewatering section, a press apparatus, and/or a press section, as well as vacuum devices and/or a molding apparatus. The drying section may also include different types of dewatering apparatuses, for instance, a through-air dryer or other types of dewatering apparatuses, or multiples of such dewatering apparatuses, on one or more levels.

FIG. 6 schematically illustrates a through-air dryer (TAD) based upon a cylindrical roll, wherein such a TAD may be used in a papermaking machine 25 for dewatering and/or drying a paper web 75, and wherein the TAD is generally indicated by the numeral 125. The term "drying" as used herein with respect to, for example, a TAD or a TAD fabric, will also be appreciated by one skilled in the art to also indicate that the term "dewatering" may be associated therewith. That is, in instances, where the term "drying" is used, one skilled in the art will appreciate the term "dewatering" is also applicable in addition to or interchangeably therewith. A TAD 125 typically includes a cylindrical roll 150, defined by a roll shell (otherwise referred to herein as "roll 150") and an associated hood 175 (see, e.g., FIG. 1). The cylindrical shell defining the roll 150 is configured and structured so as to allow air to pass through the shell. The TAD 125 may be configured to direct heated air between the roll 150 and the hood 175 (through the shell) for drying the paper web 75. The TAD 125 is also configured to receive a fabric 100 carrying or supporting the paper web 75, wherein the fabric 100 is configured to wrap about at least a portion of the roll 150 (as the roll is rotating about its axis) so as to pass between the roll 150 and the hood 175. The TAD 125 may be configured, for example, as an outward flow TAD, wherein the heated air flows from within the roll 150, through the shell (as well as through the TAD fabric and the paper web wrapped thereabout) and into the hood 175. In an alternative, and as illustrated in FIG. 6, for example, the TAD 125 may be configured as an inward flow TAD, wherein the heated air is directed from the hood 175, through the shell (as well as through the TAD fabric and the paper web wrapped thereabout), and into the interior of the roll 150. An inward flow TAD 125 is used only for exemplary purposes herein, and is not intended to exclude an outward flow TAD configuration.

On the basis of the exemplary TAD papermaking machine 25 shown in FIG. 1, embodiments of the present invention include a papermaking clothing configured to support a wet paper web 75 for dewatering/drying. In one embodiment, such a clothing comprises a particular configuration of the fabric 100 for addressing some of the needs previously identified. For example, such a clothing may comprises an endless drying fabric (otherwise identified or referred to herein as a "TAD fabric") 100 configured in a loop, wherein the drying fabric 100 extends or runs in a machine direction 200 (i.e., the direction in which the drying fabric 100 runs/moves when the papermaking machine 25 is in operation) and has opposed lateral edges 225 (of which only one lateral edge is represented in FIG. 6, with the opposing lateral edge being a substantial mirror image thereof). The fabric 100 may be formed, for example, only from a woven material so as to have a single, substantially consistent, permeability to air such as, for example, between about 2.2 m/s and about 3.0 m/s, at a pressure of about 100 Pa and a temperature of about 20° C. That is, the fabric 100 is configured to have only the woven structure, without any internal skeleton structure, and such a woven configuration distinguishes the fabric 100 from, for example, a perforated belt of a solid material. Such a fabric 100 may be formed or woven, for example, from relatively thin threads comprised of, for instance, a polymeric material. In one advantageous aspect, the fabric 100 further comprises a pair of laterally spaced-apart strip portions 250 extending along the drying fabric 100 in the machine direction 200 (i.e. along the run of the fabric 100 as the fabric 100 proceeds around the loop). Each strip portion 250 is substantially and consistently impermeable to air. For example, in one instance, the strip portions 250 may be impermeable to air at a pressure of about 100 mmWC. In other instances, the strip portions 250 may be substantially impermeable to air at a pressure of about 60 kPa, or otherwise completely impermeable.

In one embodiment, the strip portions 250 may be formed by applying a self-leveling filler substance to the drying fabric 100. For example, the filler substance (not shown) may be applied as a liquid to the woven material of the fabric 100. Upon application, the filler substance fills the woven structure of the fabric 100 over the width and length of each strip portion 250 and then sets into a flexible solid having a substantially and consistently smooth surface. That is, the filler substance may comprise, for example, an epoxy material or a silicone material that, when applied to the drying fabric 100 as a liquid, "self-levels" or becomes smooth as the filler substance sets into a flexible solid. In other instances, the woven thin polymeric threads forming the drying fabric 100 may be exposed to a combination of pressure and heat so as to "melt" the polymeric threads, which then re-form as an impermeable polymeric sheet upon removal of the pressure/heat. Such a process applied to the drying fabric 100 along the run thereof (i.e., in the machine direction 200) at or about the opposing lateral edges of the drying fabric 100, may also result in the formation of the strip portions 250. One skilled in the art will appreciate, however, that the strip portions 250, as disclosed, may be formed in different manners consistent with the spirit and scope of the present invention.

The strip portions 250 are also desirably consistent in width, thickness, cross-sectional shape, and the like, with substantially consistent laterally inward edges and a substantially consistent lateral spacing therebetween. In one instance (i.e., an inward flow TAD as shown, for example, in FIGS. 1 and 6), the substantially smooth surface of the strip portion 250 is directed outwardly of the loop of the fabric 100 such that, when the fabric 100 is installed about the TAD roll, the substantially smooth surface of each strip portion 250 is directed away from the roll 150 toward the paper web 75 (i.e., oriented substantially unidirectionally with the web-supporting surface or paper carrying side of the fabric 100). In another instance (i.e., an outward flow TAD), the substantially smooth surface of each of the strip portions 250 may be directed toward the paper web 75, as well as toward the roll 150. That is, for any TAD configuration, the substantially smooth surface of each of the strip portions 250 is directed toward the paper web 75. However, one skilled in the art will appreciate that the opposing surfaces of each strip portion 250, the surface directed toward the paper web 75, as well as the opposing surface on the opposite side of the drying fabric 100 and directed away from the paper web 75, may both be substantially smooth, if desired. As discussed further herein, the substantially and consistently smooth surface of each strip portion 250 is adapted to not retain water so as to reduce the amount of water brought into the TAD 125 by the fabric 100. That is, the substantially and consistently smooth surface causes any water deposited thereon to run off, as compared to a rough or cratered surface, which would retain any water deposited thereon and carry that water into the TAD 125. As a result, energy savings in the TAD 125 may result since energy input is not longer required to remove water brought into the TAD 125 by the strip portions 250.

The strip portions 250 may be, for example, at least about 2.5 cm wide to ensure that the paper web 75 does not extend across the width thereof. In some instances, each strip portion 250 may desirably have a width of about 13 cm. Further, the formed strip portions 250 may be thicker than, thinner than, or substantially the same thickness as, the woven structure of the fabric 100. In addition, the strip portions 250 may, but do not necessarily, define the opposing lateral edges 225 of the fabric 100. That is, portions of the woven structure of the fabric 100 may extend laterally outward of either or both of the strip portions 250. The strip portions 250 also define a web-carrying portion 275 of the drying fabric 100 therebetween. The width of the web-carrying portion 275 may vary depending on many factors such as, for example, the requirements of a particular product to be formed from the paper web 75. That is, the web-carrying portion 275 is particularly adapted to carry the paper web 75 for drying. Common widths of the web-carrying portion 275 may vary, for example, from about 50 cm to about 600 cm. Because of the single, substantially consistent, permeability of the woven material forming the web-carrying portion 275 of the fabric 100, the wet paper web 75 supported by the web-carrying portion 275 can extend over the entire width thereof. As such, the web-carrying portion 275 of the fabric 100 is configured to allow air directed thereat by the TAD 125 to flow therethrough, exclusively of the strip portions 250. In this manner, the wet paper web 75 supported only by the web-carrying portion 275 is dried in the TAD 125, wherein the width of the web-carrying portion 275, between the strip portions 250, defines a width of the wet paper web 75 being dried thereon.

The fabric 100 thus configured with the spaced-apart strip portions 250 to define the web-carrying portion 275 therebetween, is further configured to cooperate with the TAD 125 to form a system for drying a wet paper web 75. As shown in FIG. 6, such a fabric 100 can be applied in a TAD 125 having a rotatable roll 150 that does not include deckle bands. Such a roll 150 includes a medial portion 155 configured to allow air to flow therethrough and solid distal portions 160 (also referred to herein as "edge portions 160" and which may or may not be existing deckle bands) which hold and support the shell structure of the medial portion 155, and define the lateral ends of the roll 150. In such a configuration, the medial portion 155 defines the maximum width over which air can be directed into or out of the roll 150, as the roll 150 rotates. Accordingly, in some instances, the desired width of the paper web 75 may be somewhat less than the width of the medial portion 155 of the roll 150. In such instances, the desired width of the paper web 75 corresponds to the width of the web-carrying portion 275 of the fabric 100. As a result, the strip portions 250 are configured to be of sufficient width to extend laterally outward so as to overlap or at least partially cover the edge portions 160 of the TAD roll 150. That is, once the desired width of the paper web 75 is determined and defined by the web-carrying portion 275, the strip portions 250 are configured to extend over the gap 300 (see, e.g., FIG. 3 for an illustration of the gap 300) between each of the lateral edges of the paper web 75 and the corresponding edge portions 160 of the roll 150.

The fabric 100 is configured to withstand a temperature of at least about 120° C. and, in some instances, a temperature of at least about 280° C., without premature degradation. As such, the fabric 100 is configured to withstand the heated air flowing between the hood 175 and the roll 150 of the TAD 125, and the strip portions 250 are sufficiently flexible and elastic to withstand continuous travel/stretching when running about the roll 150 during the papermaking process. The strip portions 250 are also sufficiently durable to withstand fabric cleaning processes such as, for example, through a water spray nozzle cleaning process, without affecting the characteristics thereof as discussed herein. Because the strip portions 250 cover the gap 300, the heated air flowing in the TAD 125 is directed only through the web-carrying portion 275 of the fabric 100 (without using deckle bands), and therefore makes more efficient use of the air for drying the paper web 75. That is, since the web-carrying portion 275 is configured for the width of the paper web 75, and the paper web 75 extends over the entire width of the web-carrying portion 275, substantially all of the air flowing through the TAD 125 flows through both the web-carrying portion 275 and the paper web 75, to dry the paper web 75. Further, the web-carrying portion 275 will be cooled by evaporation of the water within the paper web 75, thereby reducing or minimizing premature degradation of the fabric 100, as compared to the heated air flowing through portions of the fabric 100 not covered by the paper web 75 (i.e., in previous configurations using deckle bands).

The TAD 125 configured with the fabric 100 having the laterally-spaced strip portions 250, as discussed, thus protects the lateral edges 225 of the fabric 100 from having hot TAD supply air flowing therethrough by eliminating the gap 300 between lateral edges of the paper web 75 and the edge portions 160 of the roll 150, through which hot air previously passed in TADs using conventional deckle bands. In this manner, the service life of the fabric 100 may be increased by minimizing or eliminating fabric degradation in the gap 300, while allowing higher temperatures (i.e., over about 200° C.) of the supply air in the TAD 125 to be utilized. The increased efficiency and/or production capacity realized by more effective use of the drying air, in addition to the faster drying realized by the higher supply air temperatures, thus provide an advantageous system for drying a wet paper web 75. Since deckle bands are eliminated, previous shortcomings such as, for example, machine start-up issues with temporary deckle bands, shutdown after initial start-up for "permanent" deckle band installation, corrosion of the roll associated with deckle bands, and cleaning issues associated with the TAD roll 150, are also substantially eliminated. In addition, since the gap 300 is also eliminated by the strip portions 250 of the fabric 100, the need for gap protection measures such as, for example, air knife edge cooling and water spray edge protection, are also eliminated. As such, the system requires less equipment, and is thus less costly and less maintenance-intensive.

Another aspect of the fabric 100 having the laterally-spaced strip portions 250 is the capability of determining a width of a paper web 75 being produced. As previously discussed, the paper web 75 may be initially formed on a forming wire 50, where at least some of the water from the initially-formed paper web 75 drains through the forming wire 50. The wet paper web 75 must then be transferred to the fabric 100 for drying in the TAD 125. In order to accomplish the transfer, the fabric 100 is typically configured to run adjacent to the forming wire 50 (as shown in FIGS. 7A and 7B), such that a downstream (in the machine direction) portion of the forming wire 50 having the wet paper web 75 thereon runs adjacent to an upstream portion of the drying fabric 100 (upstream of the TAD 125). In order to effect the transfer of the wet paper web 75 from the forming wire 50 to the drying fabric 100 as shown, for example, in FIG. 1, a pickup device, such as a vacuum/suction device 325, may be placed within the loop of the drying fabric 100 such that the suction generated thereby acts through the web-carrying portion 275 of the fabric 100 (since the suction is otherwise blocked by the strip portions 250). The suction applied by the suction device 325 thus pulls the wet paper web 75 off of the forming wire 50 and onto the TAD fabric 100 at the transfer or pickup location. In previous configurations using an edge trimming system, such edge trimming would generally occur prior to the pickup location, whereby the medial portion of the paper web 75 would be drawn from the forming wire 50 to the drying fabric 100, while the outside edge trims or excised laterally outward portions of the paper web 75 were left on the forming wire 50. In such previous configurations, however, the suction device 325 would be configured or otherwise activated only over the approximate width and portion of the drying fabric for receiving the trimmed paper web 75 in order to avoid also transferring the trimmed edge portions of the paper web 75.

The forming wire 50 of the papermaking machine 25, as discussed, may be one of the forming wires of a "twin wire former." For example, as shown in FIG. 8, the forming wire 50 may comprise the "inner forming fabric" of a C-former, with such a former having an opposed "outer forming fabric" (shown as element 60 in FIG. 8). In such instances, the fibrous slurry is deposited between the inner and outer forming fabrics, on the upstream side of the former, wherein the forming wire 50 (or "inner forming fabric") transports the formed wet paper web to the drying fabric 100. Such a twin wire former may be used, for example, in "conventional" tissue manufacturing processes. In such instances, the fabric 100 may be, for example, a felt having impermeable strips 250 defining the web-carrying portion thereof, as will be appreciated by one skilled in the art. The paper web 75 is transferred from the inner forming wire 50 to the web-carrying portion of the felt, for example, by a vacuum device. The web 75 may then be, for instance, pressed onto a Yankee dryer to implement a press dewatering process, before the paper web 75 is transferred to the Yankee dryer for final drying.

Further, as shown in FIG. 8, embodiments of the present invention may also be applicable to a papermaking machine that does not include a TAD. For example, FIG. 8 is a schematic representation of a paper machine 500 for manufacturing high bulk, structured paper. The paper machine 500 comprises a wet end 550 and a drying section 650, but has no press section. The wet end 550 comprises a head box 555 and a wire section. The wire section further comprises a forming roll and the two forming wires 50 and 60. Each of the forming wires 50,60 runs in a closed loop around a plurality of guide rolls. The forming wires 50,60 receive a stock jet from the head box 555 therebetween, wherein a continuous fiber web 75 is formed and carried downstream by the inner forming wire 50. The wire section may comprise a steam box 580 arranged outside the inner forming wire 50 for heating the web 75, and a suction box 585 arranged inside the inner forming wire 50 for removing water from the web 75 through the inner forming wire 50.

Downstream of the wire section, the wet end 550 may further comprise a structuring section 600, extending from the wire section to the drying section 650. The structuring section 600 comprises the structuring fabric 100 running in a closed loop around a plurality of guide rolls (accordingly, the structuring fabric 100 may be other open-structure fabrics besides a TAD fabric). A transfer box 605 is arranged inside the loop of the fabric 100 for facilitating transfer of the web 75 from the wire section to the structuring section 600 by bringing the fabric 100 against the inner forming wire 50 wherein the suction through the fabric 100 from the transfer box 605 picks up the web 75 from the inner forming wire 50. After the transfer box 605, the web 75 is carried by the structuring fabric 100 through the structuring section 600 comprising at least one dewatering unit (i.e., at least one dewatering member or device facing towards the free side of the web 75). The dewatering unit may comprise, for example, a steam box 615 being arranged outside the loop of the fabric 100 and facing towards the free side of the web 75, and a suction box 620 arranged inside the loop of the fabric 100 opposite to and/or downstream of the steam box 615. The steam box 615 serves to raise the temperature of the web 75 and the water therein, which increases the dewatering capacity of the subsequent suction box 620 by reducing the viscosity of the water. In the alternative, the dewatering members or devices in the dewatering unit can for example, heat the web 75 using infrared radiation or hot air. A smooth and solid transfer roll 655 is arranged inside the loop of the fabric 100 for transferring the web 75 from the fabric 100 to a hot drying surface of the drying section 650 by forming a transfer nip 665 for the web 75. In some instances, a Yankee dryer 670 having an associated hood may provide the hot drying surface for drying the web 75, whereafter the web 75 is removed from the drying surface, for instance, by a creping doctor.

In accordance with embodiments of the present invention, the fabric 100 configured with the laterally-spaced strip portions 250 controls or limits the effective area of the applied suction from the suction device 325 (as well as the suction box 585, the transfer box 605, and the suction box 620, and such an effect will be apparent to one skilled in the art). In such instances, the suction is applied through the web-carrying portion 275 to draw only the desired width of the paper web 75 to the drying fabric 100, without requiring edge trimming, to ensure a clean separation of the trimmed paper web 75 from the excised edge portions. That is, a full width paper web, as formed on the forming wire 50 enters the pickup location at between about 10% to about 40% dryness, wherein the pickup suction draws a medial portion of the wet paper web 75, equal to the width of the web-carrying portion 275, from the forming wire 50 to the web-carrying portion 275 of the TAD fabric 100. However, one skilled in the art will appreciate that the dryness of the wet paper web 75, upon transfer to the fabric 100, may vary. The strip portions 250 prevent the outer edge portions of the formed paper web 75 from being exposed to the pickup suction. As such, with a certain degree of adhesion between the outer edge portions of the paper web 75 and the forming wire 50, and with no exposure to the pickup suction because of the strip portions 250 of the drying fabric 100, the outer edge portions of the paper web 75 remain on the forming wire, thereby essentially trimming the formed paper web 75 and creating uniform lateral edges of the paper web 75. Further, the width of the paper web 75 transferred to the drying fabric 100 will be equal to the width of the web-carrying portion 275 of the fabric 100. In addition, the substantially and consistently smooth surface of each strip portion 250 reduces the propensity of the strip portions 250 to retain water thereon and, as such, reduces or eliminates the likelihood of the trimmed edge portions of the paper web 75 adhering to the strip portions 250 and separating from the forming wire 50. As such, the lateral edges of the wet paper web 75 are trimmed to realize a desired width paper web 75, without requiring extraneous edge trimming equipment, thereby realizing cost savings and efficiencies in terms of less equipment, less maintenance, less required energy, and no required fresh water supply over previous edge trimming systems. Further, "inner" edge trimming (i.e., a second edge trimming process to determine the desired width of the finally dried paper web 75) requirements may also be reduced or eliminated, thereby reducing or eliminating re-pulping of dry trimmings as a result.

Because the fabric 100 (having the laterally-spaced strip portions 250) itself, in combination with the pickup suction, trims the edges of the paper web 75 received from the forming wire 50, the trimmed paper web 75 extends across the entire width of the web-carrying portion 275 of the fabric 100. As a result of the paper web 75 extending across the entire width of the web-carrying portion 275, the fabric gap 300 is eliminated as an airflow path in the TAD 125. Water evaporation from the paper web 75 in the TAD 125 thus protects the web-carrying portion 275 of the fabric 100 from the heated air in the TAD 125, while the strip portions 250 of the fabric 100 may also reduce convective heat transfer. Because portions (i.e., the gap 300) of the fabric 100 are no longer exposed to unacceptable temperature levels of the heated air in the TAD 125, premature degradation of the fabric 100 is avoided and, in some instances, allows higher temperatures of the supply air in the TAD 125 to be utilized without a significant risk of damage to the fabric 100.

The fabric 100 employing the laterally-spaced strip portions 250 may also simplify and/or facilitate other processes or processing of the paper web 75 within the papermaking machine 25. For example, in instances where a molding device 350 is implemented, the fabric 100 thus configured may simplify the set up of the molding device 350 for affecting the appropriate width of the paper web 75 (i.e., eliminate requirements for deckles associated with the molding box). As such, embodiments of the present invention may eliminate edge trimming systems, as well as deckle requirements for the suction device 325, the molding box 350, and/or the TAD roll 150, while also facilitating alignment of the components of the papermaking machine 25. Further advantages are realized in time savings associated with aligning deckles, reduced risk for poor quality of the dried paper web 75 because of wet or damaged lateral edges, and more efficient drying of the paper web 75 (since no supply air bypasses the paper web about the gap 300), in addition to overall energy savings. Still other advantages may be realized in instances where the desired width of the paper web 75 is changed. In such instances, the width of the paper web 75 may be readily changed by altering the lateral spacing of the strip portions 250, which can be accomplished by changing the fabric 100 to one having the appropriate lateral spacing of the strip portions 250. That is, a first fabric 100 having a first width of the web-carrying portion 275 is changed to a second fabric 100 having a second width of the web-carrying portion 275, wherein the widths of the web-carrying portions 275 are different, with both widths being less than the width of the formed paper web 75. Otherwise, converting a papermaking machine to produce a paper web 75 of a different width may involve changing the width of the parent roll (i.e., by adjusting the lateral spacing of an edge trimming system). Different width products may be encountered, for example, in bath product vs. towel product, which are often made on the same papermaking machine 25. Optimizing the width of the paper web 75 for each different product may thus increase drying efficiency, while lowering costs.

Another aspect of the present invention comprises a composite fabric 700 as shown in a partial plan view in FIG. 9. The composite fabric has a central fabric portion 710, a first fabric side portion 720, and a second fabric side portion 730. MD indicates the machine direction of the composite fabric 700. The first fabric side portion 720 and the second fabric side portion 730 are generally interchangeable. The central portion 710 can be any woven TAD fabric. The material used for the central portion 710, also known as the body of the composite fabric, is preferably at least one of polyester and polyethylenepterathalate (PET). The first fabric side portion 720, or new edge material, is added to the central fabric portion 710. That is, the central fabric portion 710 of the fabric running in the machine direction has additional side panels 720,730. The paper web 75 generally covers the central fabric portion 710, and overlays, or extends to cover a portion of the side portions 720,730 at first and second paper web overlays 740,750.

In the composite fabric 700, the first side portion 720 is woven to the central fabric portion 710 along a first side edge 760. The second fabric side portion 730 is woven to the central fabric portion 710 along a second side edge 770. The second side edge 770 is opposite the first side edge 760. The first and second fabric side portions 720,730 can be woven to the central fabric body 710. This weaving of the first and second fabric side portions 720,730 to the central fabric body 710 is preferably performed on the same loom on which the central fabric body was woven. There is no requirement that the first fabric side portion 720 have the same weave pattern as the central fabric portion 710 or the second fabric side portion 730. In one embodiment, the first and second fabric portions 720,730 have the same weave pattern. Additionally, the first and second fabric portions 720,730 may have the same weave pattern as the central fabric portion 710.

Still further, the first and second fabric side portions 720, 730 can be subjected to the same processing as the central fabric portion 710. For example, heat setting, stretching, coating, and the like. When a coating is utilized, the coating, when compared to a composite fabric without the coating, has at least one of enhanced release properties, enhanced wear properties and enhanced thermal stability. The material used for the central fabric portion 710 of the composite fabric 700 is preferably at least one of polyester and polyethylenepterathalate (PET). The material used for the first fabric side portion 720 and/or the second fabric side portion 730 is at least one of polyphenylenesulfide (PPS), polyetheretherketone (PEEK), high temperature and hydrolysis resistant polymers, blends using PPS, blends using PEEK, alloys of PPS, alloys of PEEK, and high temperature nylon. The high temperature nylon is at least one of a variant of nylon 66 and an aromatic nylon. Additionally, the diameter of first fabric side portion fibers 780 used for the first fabric side portion 720, and the diameter of second fabric side portion fibers 790 used for the second fabric side portion 730 can be substantially the same as the diameter of the central fabric portion fibers 800 used for the central fabric portion 710. When the first (and second) side portion 720 is woven to the fabric body 710, it is woven in the same plane. It is preferred that the fabric body 710 and the first (and second) side portion 720 have substantially the same CFM throughput. However, depending on the design parameters, the CFM throughput of the first (and second) side portion 720 can be different from the fabric body 710, or may be different from the second side portion 730. Additionally, it is preferred that there is a smooth transition between the main portion 710 of the fabric and the side portions 720,730. The size of the first and second fabric side portions 720,730 is predetermined and can be based upon the size of the paper web. In one embodiment, the width of each of the fabric side portions 720,730 is approximately 10-60 cm when measured in the weft direction, preferably approximately 20-40 cm.

Many modifications and other embodiments of the inventions set forth herein will come to mind to one skilled in the art to which these inventions pertain having the benefit of the teachings presented in the foregoing descriptions and the associated drawings. For example, a papermaking clothing as disclosed herein may be implemented in other paper web forming systems and processes such as, for example, a vacuum dewatering system and process. Therefore, it is to be understood that the inventions are not to be limited to the specific embodiments (i.e., TAD papermaking machines or non-TAD papermaking machines) disclosed and that modifications and other embodiments (i.e., for other papermaking processes) are intended to be included within the scope of the appended claims. Although specific terms are employed herein, they are used in a generic and descriptive sense only and not for purposes of limitation.

What is claimed is:

1. A system for drying a wet paper web, comprising: at least one through-air dryer including a cylinder defined by a shell configured so as to allow air to pass therethrough, the cylinder being further configured to rotate in a machine direction; and an endless drying fabric formed only from a woven material so as to have a single, substantially consistent, permeability, the drying fabric defining a machine direction, having opposed lateral edges, and being wrapped about at least a portion of the cylinder, the drying fabric further including a pair of laterally spaced apart strip portions extending along the drying fabric in the machine direction, each strip portion being substantially and consistently impermeable and having a substantially and consistently smooth surface adapted to not retain water, the strip portions defining a web-carrying portion of the drying fabric therebetween, the web-carrying portion being configured such that the wet paper web supported thereby, on a web-side surface thereof, extends over an entire width thereof, whereby the web-carrying portion is configured to allow air directed thereat by the at least one through-air dryer to flow therethrough, exclusively of the strip portions, such that the wet paper web supported only by the web-carrying portion is dried, the width of the web-carrying portion between the strip portions thereby defining a width of the wet paper web being dried by the at least one through-air dryer.

2. A system according to claim 1 wherein the drying fabric is configured to withstand a temperature of at least about 120° C.

3. A system according to claim 1 wherein each strip portion has a width of at least about 2.5 cm.

4. A system according to claim 3 wherein the cylinder is at least as wide as the drying fabric, inclusive of the widths of the strip portions.

5. A system according to claim 1 wherein the substantially and consistently smooth surface of each strip portion is oriented unidirectionally with the web-side surface of the drying fabric.

6. A system according to claim 1 wherein the strip portions are impermeable to air at a pressure of about 100 mmWC.

7. A system according to claim 1 wherein the strip portions are substantially impermeable to air at a pressure of about 60 kPa.

8. A system according to claim 1 wherein an outer edge of one of the strip portions defines one of the opposed lateral edges of the drying fabric.

9. A system according to claim 1 further comprising a forming wire configured to have the wet paper web formed thereon such that the wet paper web is wider than the web-carrying portion of the drying fabric, wherein the forming wire is further configured to transport the wet paper web into engagement with the drying fabric such that only the web-carrying portion of the drying fabric receives the wet paper web, exclusively of the strip portions, thereby trimming the wet paper web to the width of the web-carrying portion.

10. A system according to claim 9 further comprising a suction device operably engaged with the drying fabric and configured to impart suction through the web-carrying portion thereof such that the wet paper web having the width of the web-carrying portion is received by the drying fabric from the forming wire.

11. A method of dewatering a wet paper web in a through-air dryer ("TAD") papermaking system, comprising: carrying a wet paper web in a machine direction with an endless web-carrying TAD fabric formed only from a woven material so as to have a single, substantially consistent, permeability, the web-carrying TAD fabric having opposed lateral edges and further including a pair of laterally spaced apart strip portions extending along the web-carrying TAD fabric in the machine direction, each strip portion being substantially and consistently impermeable and having a substantially and consistently smooth surface adapted to not retain water, the impermeable strip portions defining a permeable portion of the web-carrying TAD fabric therebetween, the permeable portion being configured such that the wet paper web carried thereby extends over an entire width thereof; and directing air toward the web-carrying TAD fabric, the permeable portion thereof being configured to allow the air to flow therethrough, exclusively of the impermeable strip portions, such that the wet paper web carried only by the permeable portion is dewatered, the width of the permeable portion between the impermeable strip portions thereby defining a width of the wet paper web being dewatered on the web-carrying fabric.

12. A method of processing a paper web in a through-air dryer ("TAD") papermaking system, comprising: carrying a paper web in a machine direction with an endless TAD fabric formed only from a woven material so as to have a single, substantially consistent, permeability, the TAD fabric having opposed lateral edges and further including a pair of laterally spaced apart strip portions extending along the TAD fabric in the TAD machine, each strip portion being substantially and consistently impermeable and having a substantially and consistently smooth surface adapted to not retain water, the impermeable strip portions defining a permeable web-carrying portion of the TAD fabric therebetween, the permeable web-carrying portion being configured such that the paper web carried thereby extends over an entire width thereof; and directing air toward the TAD fabric so as to process the paper web, the permeable web-carrying portion thereof being configured to allow the air to flow therethrough, exclusively of the impermeable strip portions, such, that the paper web carried only by the permeable web-carrying portion is processed, the width of the permeable web-carrying portion between the impermeable strip portions thereby defining a width of the paper web being processed on the fabric.

13. A method according to claim 12 wherein directing air toward the TAD fabric so as to process the paper web further comprises directing air toward the TAD fabric with at least one of a vacuum device and a molding device, so as to apply suction to the paper web, to mold the paper web, and to dry the paper web, respectively.

14. A method of protecting a through-air drying fabric carrying a paper web, comprising: carrying a paper web in a machine direction with an endless fabric formed only from a woven material so as to have a single, substantially consistent, permeability, the fabric having opposed lateral edges and further including a pair of laterally spaced apart strip portions extending along the fabric in the machine direction, each strip portion being substantially and consistently impermeable and having a substantially and consistently smooth surface adapted to not retain water, the strip portions defining a web-carrying portion of the fabric therebetween, the web-carrying portion being configured such that the paper web carried thereby extends over an entire width thereof; and directing high temperature air toward the fabric such that the air flows through the web-carrying portion, exclusively of the strip portions, and interacts with the web-carrying portion only where the paper web is carried thereby, the paper web extending across the entire width of the web-carrying portion thereby protecting the web-carrying portion of the fabric from the high temperature air.

15. A method according to claim 14 wherein directing high temperature air toward the fabric further comprises directing high temperature air toward the fabric with a through-air drying device.

16. A system for dewatering or drying a wet paper web in a through-air dryer ("TAD") papermaking system, comprising: at least one TAD processing device configured to provide a flow of air; and an endless TAD fabric formed only from a woven material so as to have a single, substantially consistent, permeability, the TAD fabric defining a machine direction, having opposed lateral edges, and being configured to interact with the at least one TAD processing device, the TAD fabric further including a pair of laterally spaced apart strip portions extending along the TAD fabric in the machine direction, each strip portion being substantially and consistently impermeable and having a substantially and consistently smooth surface adapted to not retain water, the strip portions defining a web-carrying portion of the TAD fabric therebetween, the web-carrying portion being configured such that the wet paper web supported thereby, on a web-side surface thereof, extends over an entire width thereof, whereby the web-carrying portion is configured to allow the air provided by the at least one TAD processing device to flow therethrough and process the wet paper web, exclusively of the strip portions, such that the wet paper web supported only by the web-carrying portion is at least one of dried and dewatered, the width of the web-carrying portion between the strip portions thereby defining a width of the wet paper web being processed on the fabric by the at least one TAD processing device.

17. A system according to claim 16 wherein the at least one TAD processing device is configured to provide the air flow at a temperature of at least about 120° C.

18. A system according to claim 16 wherein the at least one TAD processing device further comprises one of a vacuum dewatering device and a molding device configured to provide the air flow at an ambient temperature.

19. A system according to claim 16 wherein each strip portion has a width of at least about 2.5 cm.

20. A system according to claim 19 wherein the at least one TAD processing device is at least as wide as the fabric.

21. A system according to claim 16 wherein the substantially and consistently smooth surface of each strip portion is oriented unidirectionally with the web-side surface of the fabric.

22. A system according to claim 16 wherein the strip portions are impermeable to air at a pressure of about 100 mmWC.

23. A system according to claim 16 wherein the strip portions are substantially impermeable to air at a pressure of about 60 kPa.

* * * * *